US006725911B2

(12) United States Patent
Jayaweera et al.

(10) Patent No.: US 6,725,911 B2
(45) Date of Patent: Apr. 27, 2004

(54) CORROSION RESISTANCE TREATMENT OF CONDENSING HEAT EXCHANGER STEEL STRUCTURES EXPOSED TO A COMBUSTION ENVIRONMENT

(75) Inventors: Palitha Jayaweera, Fremont, CA (US); Angel Sanjurjo, San Jose, CA (US); Kai-Hung Lau, Cupertino, CA (US)

(73) Assignee: Gas Research Institute, Des Plaines, IL (US)

( * ) Notice: Subject to any disclaimer, the term of this patent is extended or adjusted under 35 U.S.C. 154(b) by 0 days.

(21) Appl. No.: 09/966,999

(22) Filed: Sep. 28, 2001

(65) Prior Publication Data

US 2003/0066631 A1 Apr. 10, 2003

(51) Int. Cl.[7] ..... F28F 13/18
(52) U.S. Cl. ..... 165/133; 165/905; 165/134.1
(58) Field of Search ..... 165/133, 134.1, 165/DIG. 513; 228/183; 427/459

(56) References Cited

U.S. PATENT DOCUMENTS

| | | | | | |
|---|---|---|---|---|---|
| 3,053,511 | A | * | 9/1962 | Godfrey | 165/133 |
| 3,669,851 | A | | 6/1972 | Garvey | |
| 3,871,328 | A | * | 3/1975 | English | 118/323 |
| 3,948,245 | A | * | 4/1976 | Van der Sluys | 126/263 |
| 4,040,870 | A | | 8/1977 | Holzl | |
| 4,093,527 | A | * | 6/1978 | Tanno et al. | 204/129 |
| 4,380,965 | A | * | 4/1983 | Walling et al. | 118/621 |
| 4,822,642 | A | | 4/1989 | Cabrera et al. | |
| 4,942,922 | A | * | 7/1990 | Redmerski et al. | 165/134.1 |
| 5,113,802 | A | * | 5/1992 | Le Blanc | 122/379 |
| 5,149,514 | A | | 9/1992 | Sanjurjo | |
| 5,171,734 | A | | 12/1992 | Sanjurjo et al. | |
| 5,227,195 | A | | 7/1993 | Sanjurjo | |
| 5,242,718 | A | * | 9/1993 | Gillette et al. | 427/459 |
| 5,321,946 | A | * | 6/1994 | Abdelmalek | 60/648 |
| 5,455,068 | A | | 10/1995 | Aves et al. | |
| 5,492,727 | A | | 2/1996 | Rapp et al. | |
| 5,503,874 | A | | 4/1996 | Ackerman et al. | |
| 5,543,183 | A | | 8/1996 | Streckert et al. | |
| 5,589,220 | A | | 12/1996 | Rapp et al. | |
| 5,634,950 | A | * | 6/1997 | McLlroy et al. | 48/111 |
| 5,645,616 | A | * | 7/1997 | McIlroy et al. | 48/202 |
| 5,752,994 | A | * | 5/1998 | Monacelli et al. | 48/111 |
| 5,775,318 | A | * | 7/1998 | Haydock et al. | 126/110 R |
| 6,126,910 | A | * | 10/2000 | Wilhelm et al. | 423/210 |
| 6,197,436 | B1 | * | 3/2001 | Zayets et al. | 428/622 |
| 6,248,700 | B1 | | 6/2001 | Vollmer et al. | |
| 6,273,940 | B1 | * | 8/2001 | Bielawski et al. | 95/228 |
| 6,399,216 | B1 | * | 6/2002 | Jayaweera et al. | 428/610 |

FOREIGN PATENT DOCUMENTS

| | | |
|---|---|---|
| CA | 1004964 | 2/1977 |
| DE | 3407 293 | 9/1985 |
| EP | 0 077 535 | 4/1983 |
| EP | 0 488 165 | 6/1992 |
| JP | 61194167 | 8/1986 |
| JP | 61281856 | 12/1986 |
| JP | 02-298237 | 12/1990 |
| JP | 09-041097 | 2/1997 |
| JP | 10-204589 | 8/1998 |
| WO | WO 99/14400 | 3/1999 |

* cited by examiner

*Primary Examiner*—Terrell L McKinnon
(74) *Attorney, Agent, or Firm*—Mark E. Fejer

(57) ABSTRACT

A condensing heat exchanger structure in contact with a combustion environment and which structure includes a ferrous substrate is provided with a corrosion resistant diffusion coating applied to the ferrous substrate via a fluidized bed application. Also provided is a method for improving the corrosion resistance of a condensing heat exchanger structure which includes a ferrous substrate and a surface portion at least partially exposed to a combustion product-containing environment. In such method, a corrosion resistant diffusion coating is applied onto the ferrous substrate via a fluidized bed application.

8 Claims, 5 Drawing Sheets

CORROSION RESISTANCE TREATMENT OF CONDENSING HEAT EXCHANGER STEEL STRUCTURES EXPOSED TO A COMBUSTION ENVIRONMENT

BACKGROUND OF THE INVENTION

This invention relates generally to corrosion resistance treatment of steels and, more particularly, to the corrosion resistance treatment of condensing heat exchanger steel structures exposed to a combustion environment.

Heat exchangers are a key element in many gas furnace applications. Modem high-efficiency gas furnaces typically include a primary heat exchanger and a secondary heat exchanger mounted, in tandem. In the primary heat exchanger, hot combustion products are cooled by extracting heat at a high temperature. The resulting, partially cooled combustion products are then conveyed to the secondary heat exchanger. Typically, such secondary heat exchangers are in the form of a condensing heat exchanger and are used to effect further heat extraction and cooling. In practice, such further heat extraction and cooling commonly results in the condensation of water vapor from the products of combustion and a release of about 10 to 20 percent of the heat otherwise unavailable in the products of combustion. Consequently, furnaces equipped with such condensing heat exchangers can desirably operate at efficiencies in excess of about 88 percent. In fact, typical modem condensing furnaces can achieve AFUE (annual fuel utilization efficiency) ratings of in excess of about 96 percent.

In an effort to enhance the transfer of heat to the circulating air, most condensing heat exchangers employ a fin and tube configuration. Unfortunately, corrosion is a major problem associated with the use of condensing heat exchangers in such gas furnace applications. In particular and as will be appreciated by those skilled in the art, water condensation and evaporation cycles as are typically realized in such applications can lead to undesirable accumulations of salts and low pH conditions within such condensing heat exchangers and thus create or result in a highly aggressive and corrosive conditions within the furnace and, in particular, within or in contact with the condensing heat exchanger. Further, such corrosive conditions are typically further accentuated by the elevated temperatures associated with such combustion environment applications. In practice, such combustion environment temperatures are generally at least about 10–20° C. above ambient, with such temperatures generally falling in the range or about 50° C. to about 150° C.

As will be appreciated, such corrosive conditions and elevated temperatures can undesirably promote corrosion of low cost metal alloy materials that otherwise might find use in such applications. In particular, the presence of nitric and sulfuric oxides can result in the formation of their corresponding acids which can solubilize the otherwise protective surface oxides thus creating a very corrosive environment. Furthermore, condensation-evaporation cycles can lead to an undesirable accumulation of salts on or in the heat transfer tubes of the exchanger such as to result in a breakdown of the protective passivation oxide layer such as may be present on such metal tube surface. In particular, such metal tubes may undergo heavy localized corrosion such as to ultimately lead to "through-wall" penetration. As will be appreciated, such through-wall penetrations can pose various risks and complications dependent on the particular application. For example, such a through-wall penetration can pose a serious health hazard in residential applications wherein flue gases can mix with hot circulating air.

In view of such risks and complications, various efforts have been made to reduce or minimize the risks associated with or resulting from exposure of heat exchanger metal surfaces to such otherwise corrosive conditions. For example, condensing heat exchangers are commonly manufactured using expensive stainless steels to resist corrosion and provide desirably long life. In addition, various exotic or otherwise relatively expensive metal alloy materials, such as AL-6XN® and AL 29–4C, each available from Allegheny Ludlum Corporation, Pittsburgh, Pa., have found application in the manufacture or construction of various heat exchanger surfaces, such as heat exchanger tubing, for example, such as occur or may be included in such condensing heat exchangers. Unfortunately, such alloy materials are costly and consequently the manufacturing or production costs of such condensing heat exchangers can be greater than might be desired.

A low cost alternative to exotic and expensive alloys is to use inexpensive alloys, such as 409 SS for example, to which substrate material a corrosion resistant metallic coating has been applied. Various techniques for obtaining a corrosion resistant metallic coating on a substrate have previously been proposed. In general, however, particular coating techniques or methods, precursors, experimental conditions, and apparatus must be carefully chosen depending on the particular desired end product and the expected or anticipated exposure environments or conditions, as well as process, manufacture and production economics.

Identified below are certain such previously disclosed coating techniques. It is critically important to note that, though these previously disclosed coating techniques seek to improve the corrosion resistant of particular substrate materials, they fail to show or suggest the protective coating application onto a substrate metal, such as of ferrous metal, to provide or result in corrosion protection properties to structures formed of such a substrate metal for extended periods of time such as when used in a condensing heat exchanger structure and when disposed in extremely aggressive environments such as a combustion environment involving exposure to combustion products at significantly elevated temperatures.

The diffusion coating of a metal by the simultaneous deposition of Cr and Si onto the metal is taught by U.S. Pat. No. 5,492,727 and related U.S. Pat. No. 5,589,220. The method utilizes a halide-activated cementation pack with a dual halide activator. These patents specifically disclose the codeposition of chromium and silicon and a minor cerium or vanadium content for the coating of a workpiece. These patents further identify and describe resulting workpiece corrosion protection in a chloride and sulfate-containing environment at ambient temperature.

A chemical vapor deposition (CVD) method for case hardening a ferrous metal interior tubular surface by exposure to diffusible boron with or without other diffusible elements such as silicon to enhance the wear, abrasion and corrosion resistance of the tubular surface is taught by U.S. Pat. No. 5,455,068. The use of chemical vapor deposition for deposit of aluminum and a metal oxide on substrates for improved corrosion, oxidation, and erosion protection is taught by U.S. Pat. No. 5,503,874.

A method for producing materials in the form of coatings or powders using a halogen-containing reactant which reacts with a second reactant to form one or more reactive intermediates from which the powder or coating may be formed by disproportionation, decomposition, or reaction is taught by U.S. Pat. No. 5,149,514.

U.S. Pat. No. 4,822,642 teaches a silicon diffusion coating formed in the surface of a metal article by exposing the metal article to a reducing atmosphere followed by treatment in an atmosphere of 1 ppm to 100% by volume silane, with the balance being hydrogen or hydrogen plus inert gas.

A method for depositing a hard metal alloy in which a volatile halide of titanium is reduced off the surface of a substrate and then reacted with a volatile halide of boron, carbon or silicon to effect the deposition on a substrate of an intermediate compound of titanium in a liquid phase is taught by U.S. Pat. No. 4,040,870.

While the methods and resulting coatings disclosed in these patents may improve the corrosion resistance properties of a substrate material coated therewith, even if only for a very short period of time, there is a need and a demand for a protective coating for application onto a substrate metal, such as of ferrous metal, to provide corrosion protection properties to structures formed of such a substrate metal for extended periods of time such as when used in a condensing heat exchanger structure and when disposed in extremely aggressive environments such as a combustion environment involving exposure to combustion products at significantly elevated temperatures.

In view of the above, there is a need and a demand for a corrosion resistant treatment of condensing heat exchanger structures exposed to a combustion environment such as to more freely permit the use of lower cost metals, such as carbon steel and low grade stainless steel, for example, in such applications without incurring the undesired risks or complications associated with corrosion of such lower costs metals.

It is also important to note that corrosion resistance of specific condensing heat exchanger structures for particular combustion environments may require the formation or application of a very specific surface coating or composition onto particular heat exchanger structures or components. Therefore, there is a need for materials and processes that satisfy each requirement for each such environmental condition, particularly in the case of highly corrosive applications such as containing either or both sulfuric and nitric salts or their precursors.

SUMMARY OF THE INVENTION

A general object of the invention is to provide an improved corrosion resistant surface composition and treatment of condensing heat exchanger structure metals exposed to a combustion environment.

A more specific objective of the invention is to overcome one or more of the problems described above.

The general object of the invention can be attained, at least in part, through a method for improving the corrosion resistance of a condensing heat exchanger structure comprising a ferrous substrate metal and which structure includes a surface portion at least partially exposed to a combustion environment. In accordance with one preferred embodiment of the invention, such a method involves applying a corrosion resistant diffusion coating onto the ferrous substrate metal via a fluidized bed application.

The prior art generally fails to provide corrosion resistant treatment of condensing heat exchanger structure metals which are exposed to a combustion environment such as to more freely permit the use of lower cost metals, such as carbon steel and low grade stainless steel, for example, in such applications without incurring the undesired risks or complications associated with corrosion in a combustion environment of such lower cost metals. In particular, the prior art generally fails to provide structures and methods which permit the use of low-cost ferrous substrate metals, such as carbon steel and low grade stainless steel, for example.

The invention further comprehends an improvement in a condensing heat exchanger structure in contact with a combustion environment and which structure includes a ferrous substrate metal. In accordance with one preferred embodiment of the invention, such an improved structure includes a corrosion resistant diffusion coating applied to the ferrous substrate metal via a fluidized bed application.

Other objects and advantages will be apparent to those skilled in the art from the following detailed description taken in conjunction with the appended claims and drawings.

DETAILED DESCRIPTION OF THE INVENTION

The present invention provides an improved corrosion resistance treatment of metals used in condensing heat exchanger structures and exposed to a combustion environment characterized by exposure to combustion products and elevated temperatures, e.g., temperatures which are generally at least about 10–20° C. above ambient, with such elevated temperatures generally falling in the range or about 50° C. to about 150° C. As detailed below, the methods and structures of the invention are particularly helpful and effective in minimizing or avoiding the occurrence of corrosion of such a condensing heat exchanger structure in such a combustion environment such as to more freely permit the incorporation and use of relatively low cost metals, such as carbon steel and low grade stainless steel, for example, as substrate materials in the fabrication and construction of a condensing heat exchanger assembly or one or more components thereof.

Figure 1:
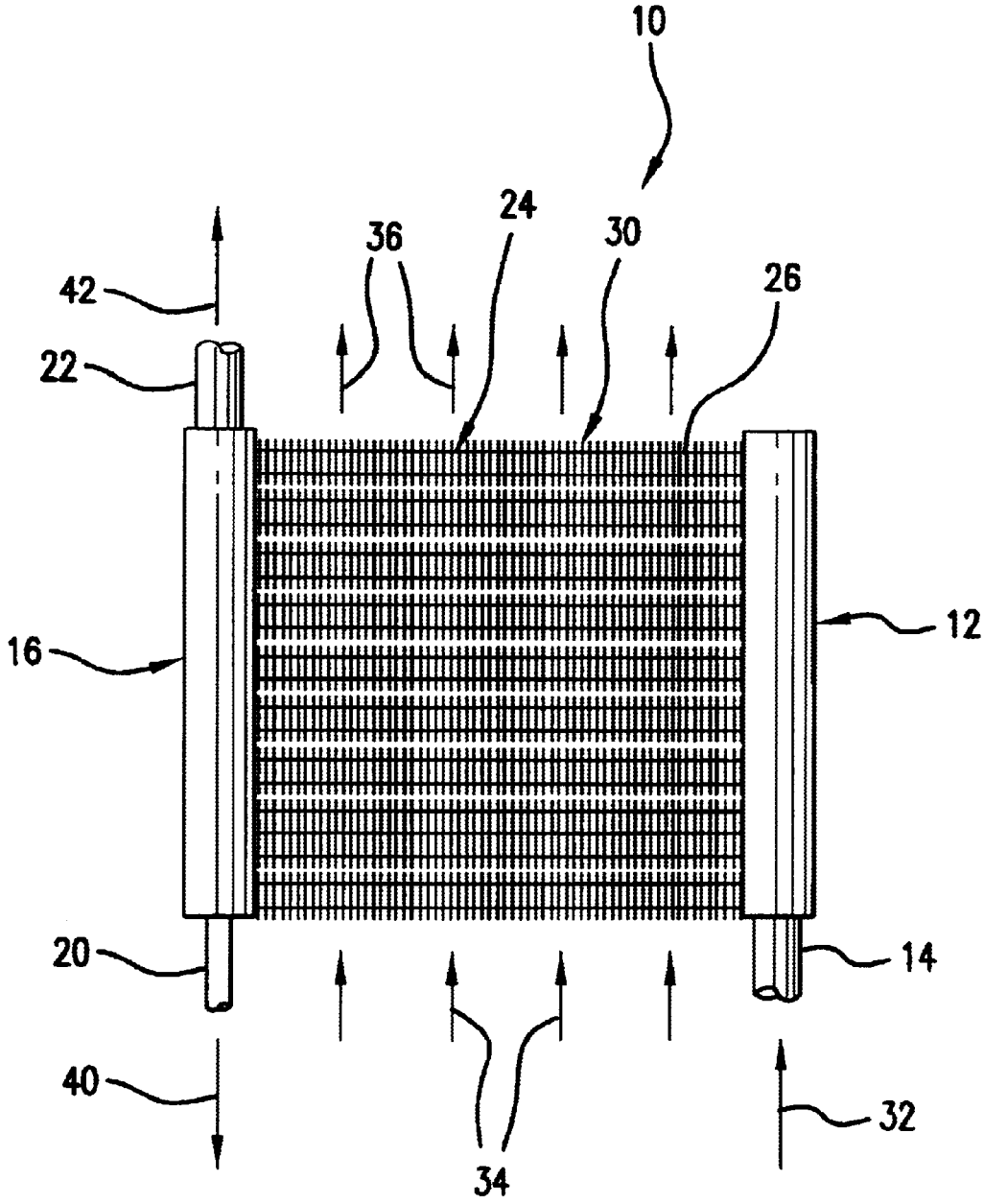
FIG. 1 is a simplified schematic drawing of a condensing heat exchanger in accordance with one preferred embodiment of the invention.

The present invention may be embodied in a variety of structures and be practiced in a variety of manners. As representative, FIG. 1 illustrates the present invention as embodied in a condensing heat exchanger, generally designated by the reference numeral 10, in accordance with one preferred embodiment of the invention. The condensing heat exchanger 10 includes an inlet header 12 having an inlet 14, an outlet header 16 having a liquid drain 20 and forming an outlet 22, and a plurality of branches 24 extending between the inlet header 12 and the outlet header 16. In the illustrated embodiment, the branches 24 are generally composed of a tube 26 having a plurality of fins 30 extending there from, as is known in the art.

In a gas furnace utilizing such a condensing heat exchanger as a secondary heat exchanger, combustion products (such as in the form of partially cooled flue gases) are passed from a primary heat exchanger (not shown) and introduced into the condensing heat exchanger 10 via the inlet 14, as represented by the arrow 32. The combustion products are then communicated through the inlet header 12 and out to the outlet header 16 via the branches 24. While passing though the branches 24, the combustion products are subject to a cooling medium, such as in the form of room air, represented by the arrows 34, passing transverse to the branch tubes 26. The inclusion or presence of heat transfer aiding elements such as in the form of fins 30 and such as may be present on or extending from the tubes 26 can desirably facilitate or improve heat transfer from the combustion products to the cooling medium. The resulting heated room air is represented by the arrows 36. As will be appreciated, heat exchangers used in the practice of the invention may include of incorporate other forms or types of heat transfer aiding elements such as known in the art. Thus, the broader practice of the invention is not necessarily limited to use in conjunction with heat exchangers having specific forms or types of heat transfer aiding elements.

Condensate formed as a result of the cooling of the combustion products passed though the heat exchanger branches 24 is passed from the outlet header 16 and out of the heat exchanger 10 via the drain 20, as represented by the arrow 40. The cooled gaseous products are passed from the outlet header 16 and out of the heat exchanger 16 via the outlet 22, as represented by the arrow 42.

As described above, water condensation and evaporation cycles as typically realized in condensing heat exchanger applications can lead to undesirable accumulations of salts and low pH conditions due to formation of acids such as sulfuric and nitric acid within the heat exchanger and thus create or result in a highly aggressive and corrosive environment within the furnace and, in particular, the condensing heat exchanger. While various condensing salts can be produced or formed in condensing heat exchangers dependent on the specific materials being processed therein, common or typical salts produced or formed in condensing heat exchangers include various chlorides (e.g., sodium chloride), sulfates (e.g., sodium sulfate), nitrates and mixtures thereof. These salts can be partially or completely hydrolyzed to form or generate acids in situ.

As described in greater detail below, at least certain selected metal surfaces of the condensing heat exchanger 10 are formed by or include a substrate metal having a corrosion resistant diffusion coating applied thereto in accordance with preferred embodiments of the invention. In particular, components of the heat exchanger 10 which convey or are or may be in contact with condensates formed therein may desirably be fabricated of or include a ferrous substrate metal having a corrosion resistant diffusion coating applied thereto in accordance with preferred embodiments of the invention. For example, heat exchanger 10 components including one or more the branch tubes 26, the outlet header 16, the drain 20 and the outlet 22 may be formed or constructed in accordance with the invention by or with such coated ferrous metal substrate.

As described in greater detail below, structures in contact with a condensing heat exchanger environment can, in accordance with certain preferred embodiments of the invention be formed using a ferrous substrate metal with a corrosion resistant diffusion coating applied thereon. For example and not necessarily limiting to the broader practice of the invention, ferrous substrate metals such as those composed of carbon steel and low grade stainless steel can desirably be used in the practice of the invention. Low grade stainless steels useful in the practice of the invention include stainless steels with low chromium contents and include 409 stainless steel and 410 stainless steel, for example. As will be appreciated, such low grade stainless steels are typically less costly or expensive, as generally compared to higher grade stainless steels. Further, corrosion resistant diffusion coatings applied to such ferrous substrate metals include diffusion coatings of one or more coating metals. In accordance with certain preferred embodiments of the invention suitable such coating metals may include at least one coating metal selected from the group consisting of Cr, Si and Ti.

While various methods are available for applying diffusion coatings of such metals onto a ferrous substrate metal, it has been found that not all such methods provide or result in the same desired properties. Thus, in accordance with certain preferred embodiments of the invention, application of such metallic diffusion coatings via fluidized-bed chemical vapor deposition is a strongly preferred coating technique.

A particularly desirable fluidized-bed chemical vapor deposition coating technique for use in the practice of at least certain preferred embodiments of the invention, is the fluidized-bed chemical vapor deposition coating technique disclosed in Sanjurjo, U.S. Pat. No. 5,149,514, issued Sep. 22, 1992; Sanjujo et al., U.S. Pat. No. 5,171,734, issued Dec. 15, 1992 and Sanjujo, U.S. Pat. No. 5,227,195, issued Jul. 13, 1993, the disclosures of which patents are incorporated herein in their entirety.

As disclosed in these patents, see Sanjurjo et al., U.S. Pat. No. 5,171,734, for example, a process for coating a substrate surface in a heated fluidized bed reactor is provided. Such process generally comprises flowing one or more coating source materials in a condensed state into a fluidized bed reactor which is maintained at a temperature which is higher than the decomposition and/or reaction temperature of the one or more coating source materials but lower than the vaporization temperature of the coating composition formed in the reactor, whereby the coating composition formed by such decomposition and/or reaction will form a coating film on the substrate surface.

While coating processing in accordance with the invention will be described in greater below, such as in association with certain of the examples, in general application of the corrosion resistant diffusion coating involves fluidized bed application at a temperature in the range of about 300° C. to about 1000° C. and a treatment time of about 5 minutes to about 4 hours. For application onto steel substrates, a temperature in the range of about 450° C. to about 1000° C. is generally preferred.

In accordance with certain preferred embodiments of the invention, it has been found that coatings of at least one metal selected from the group consisting of Cr, Si and Ti on 409 stainless steel significantly reduces the rate of corrosion of 409 stainless steel in high temperature aqueous applications. Cr, Si and Ti are preferred coating metals for use in the practice of the invention as these metals have been found to form a passive oxide surface layer such as to mitigate the rate of corrosion. In particular embodiments, such coatings of Si or Cr have been found particularly useful and desirable. Further, coatings with some degree of diffusion, that is the material being deposited, e.g., Cr, Si and Ti, is penetrated some distance, e.g., tens of microns, into the substrate matrix, have been generally found to not have, provide or otherwise result in a well-defined interface between the substrate and the coating and thus, such coatings desirably avoid delamination upon either or both, normal or designed for temperature cycling and exposure to aggressive environments, such as commonly associated with exposure of condensing heat exchanger structures to combustion environments. The coating metal and the substrate metal are interdiffused to some extent forming a metal combination or alloy at the interface. Also, a combination of metals can easily be deposited by using appropriate precursors and experimental conditions. Therefore, by controlling experimental parameters, a surface composition having corrosion resistance properties or characteristics similar to a corrosion-resistant alloy such as Duriron®, available from the Duriron Company, Dayton, Ohio for Si coatings or SiCr coatings, and the above-identified AL-6XN® and AL 29–4C, each available from Allegheny Ludlum Corporation, Pittsburgh, Pa., for Cr coatings. Thus, once the coating process is complete the invention provides a coated specimen showing corrosion resistance similar to that of more costly alloys.

The fluidized bed-applied corrosion resistant diffusion coating of a substrate metal in accordance with the invention can be further protected if desired or required by application of passivation techniques. For example, by such passivation techniques, a corrosion-protective surface compound such as a carbide, boride, nitride, silicide, oxide and mixture can desirably be formed on the surface, with surface nitridation having been found to be particularly useful. Further, in a preferred practice of the invention, surface passivation can be easily performed as a concluding step in the diffusion coating process.

For example, after the fluidized bed deposition of a protective metal, such as silicon or titanium, the coated surface can desirably be exposed to 2% $NH_3$ as a concluding step in the coating process. With such application, the ammonia can desirably react with the silicon and/or titanium to form extremely protective thin silicon or titanium nitride films.

The present invention is described in further detail in connection with the following examples which illustrate or simulate various aspects involved in the practice of the invention. It is to be understood that all changes that come within the spirit of the invention are desired to be protected and thus the invention is not to be construed as limited by these examples.

EXAMPLES

Example 1 and Comparative Example 1

In Example 1, 409 stainless steel was used as a low-cost substrate metal. A fluidizing bed containing chromium as the deposition and diffusing metal and alumina powder as an inert diluent was used in the treatment of the 409 stainless steel substrate. The fluidized bed was fluidized with argon gas, with the reactant gases (i.e., HCl and $H_2$) introduced to the argon flow. The deposition process was carried out in the 800–1000° C. temperature range. The typical deposition time was approximately one hour followed by another hour of annealing treatment at the same temperature to improve the diffusion. The metal transport mechanism is believed to operate via highly reactive halide and sub-halide species. The fluidized bed coating application process typically yielded a dull coated surface.

Results

Figure 2:
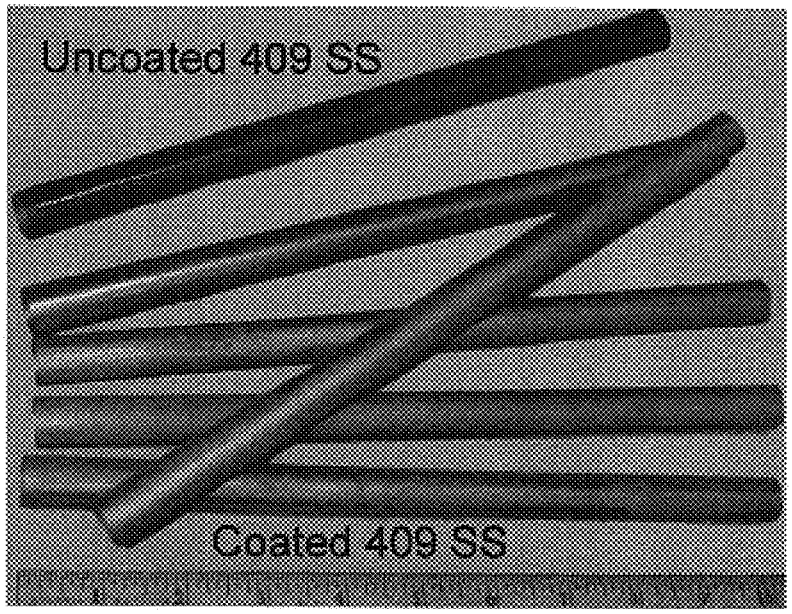
FIG. 2 is a photograph of Cr-coated 409 stainless steel tubes prepared in accordance with one embodiment of the invention.

FIG. 2 a photograph of Cr-coated 409 stainless steel tubes prepared in accordance with Example 1 and a similarly shaped and dimensioned uncoated 409 stainless steel tube (Comparative Example 1) for comparison purposes.

Example 2

The Cr-coated 409 stainless steel tubes of Example 1 were analyzed by scanning electron microscopy (SEM), energy dispersive x-ray (EDX), Auger Spectroscopy (Auger), and X-ray fluorescence spectroscopy (XRF) to determine the microstructure, composition, and diffusion profile thereof. EDX was extensively used to measure the diffusion depth profile of the coating element into the bulk substrate (see FIG. 4). Auger spectroscopy was used for analysis of the surface, e.g., top layer, of a structure or element. XRF was used mainly as a preliminary analysis tool to obtain a rapid qualitative reading of the surface composition.

For cross sectional analysis, metal specimens were cut, polished and etched to enhance the morphology of the surface.

Results

Figure 3:
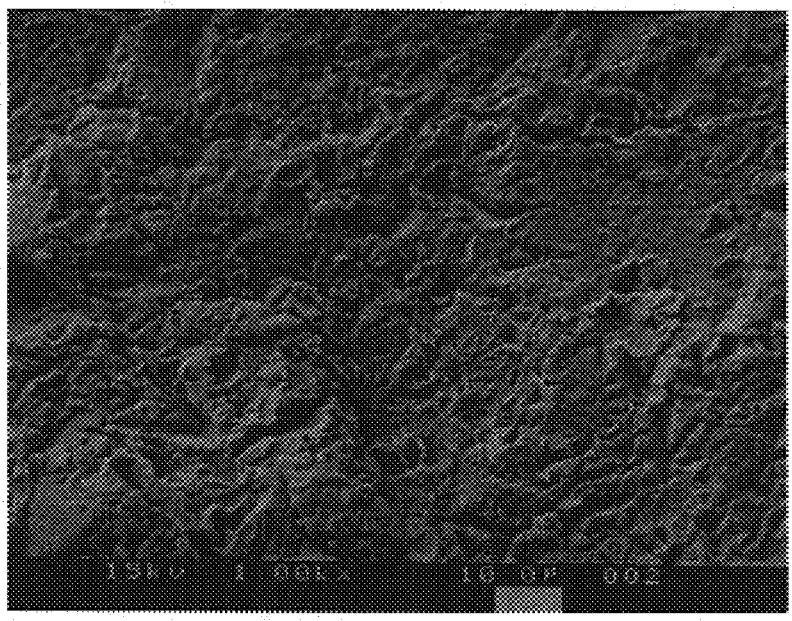
FIG. 3 is a photograph of the surface morphology of Cr-coated 409 stainless steel tubes prepared in accordance with one embodiment of the invention.

SEM was used to determine grain growth and the microstructure of the coated surface and, that of the bulk. In general, grain growth is a concern when substrates are heated to a high temperature during a coating process and thus, it must be carefully monitored and controlled to avoid changes in mechanical properties of the substrate material. FIG. 3 shows a typical surface morphology of a Cr diffusion coating on 409 stainless steel, as formed in Example 1.

Generally, the fluidized bed applied corrosion resistant diffusion coated surfaces of the invention were found to be rough. This is believed attributable to metal particle bombardment in the fluidizing bed. However, as the coating metal was deposited through the gas phase, it was found to generally uniformly follow the surface contours.

Examples 3 and 4

A series of experiments were performed to identify the experimental conditions required to obtain the best Cr diffusion profile with the lowest time-temperature budget.

In Example 3, a 1-in$^2$ 409 stainless steel coupon was coated with Cr in the fluidized bed reactor for 5 hours at 930° C., as generally described above in Example 1. In Example 4, a similar 1-in $^2$ 409 stainless steel coupon was coated with Cr in the fluidized bed reactor for 2 hours at 1000° C., as generally described above in Example 1.

Results

Figure 4:
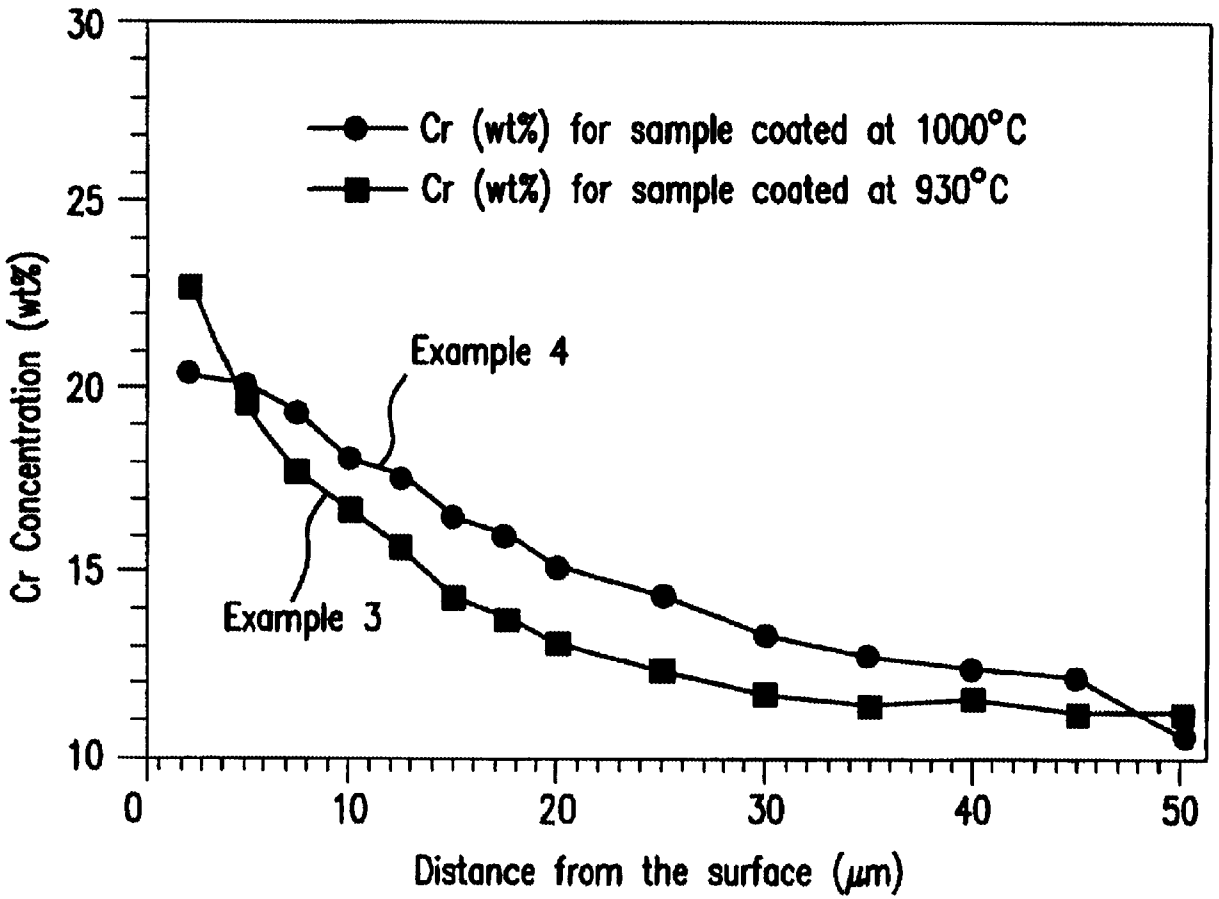
FIG. 4 is a graphical depiction of Cr concentration versus distance from the surface obtained in Examples 3 and 4 and illustrating the effect of temperature and time on the Cr diffusion obtained therein.

FIG. 4 is a graphical depiction of Cr concentration versus distance from the surface obtained in Examples 3 and 4 and illustrating the effect of temperature and time on the Cr diffusion obtained therein.

The surface morphology of the Cr-coated coupons of Examples 3 and 4 were generally similar. However, the resulting diffusion depth profiles were different, dependent on the experimental parameters. The diffusion depth profile was deeper for the Cr-coated coupon of Example 4, as compared to the Cr-coated coupon of Example 3. The diffusion depth improvement may be more prominently realized between the depths of 5 $\mu$m and 45 $\mu$m region. This indicates that though the coating time in Example 4 was reduced by factor of two as compared to the coating time in Example 3, a better diffusion depth can be realized if the temperature is increased to 1000° C., as in Example 4. Those skilled in the art and guided by the teachings herein provided will appreciate that this observation can allow one to optimize the temperature and time in a manner to desirably reduce or optimize the costs of such coating application. Further, by reducing the coating time, either or both the process throughput can be increased and/or the labor demand associated with such processing can be lowered.

Example 5 and Comparative Examples 2 and 3

To study the effect of high temperature coating processes on material microstructure, an as received 409 stainless steel coupon (Comparative Example 2) was compared with a coated 409 stainless steel coupon of Example 1 (Example 5) and a stainless steel coupon having a diffusion coating applied via pack cementation (Comparative Example 3), using SEM. In each case, the surface was cut, polished, and etched to enhance the microstructure.

Results

The mechanical properties of materials used as substrates are generally strongly related to the microstructure of such materials. As the grains of such substrate materials become large, the material tends to become hard but also more brittle. Generally it is preferred that a coating process should have minimal, if any, effect on the microstructure of the substrate material. However, high temperature coating processes typically lead to undesirable grain growth in the substrate material. Thus, in the practice of the invention it has been found that a key is to minimize the grain growth by optimizing the time-temperature budget so that the coating process does not have any significant adverse effects on the mechanical or chemical properties of the substrate.

Figure 5:
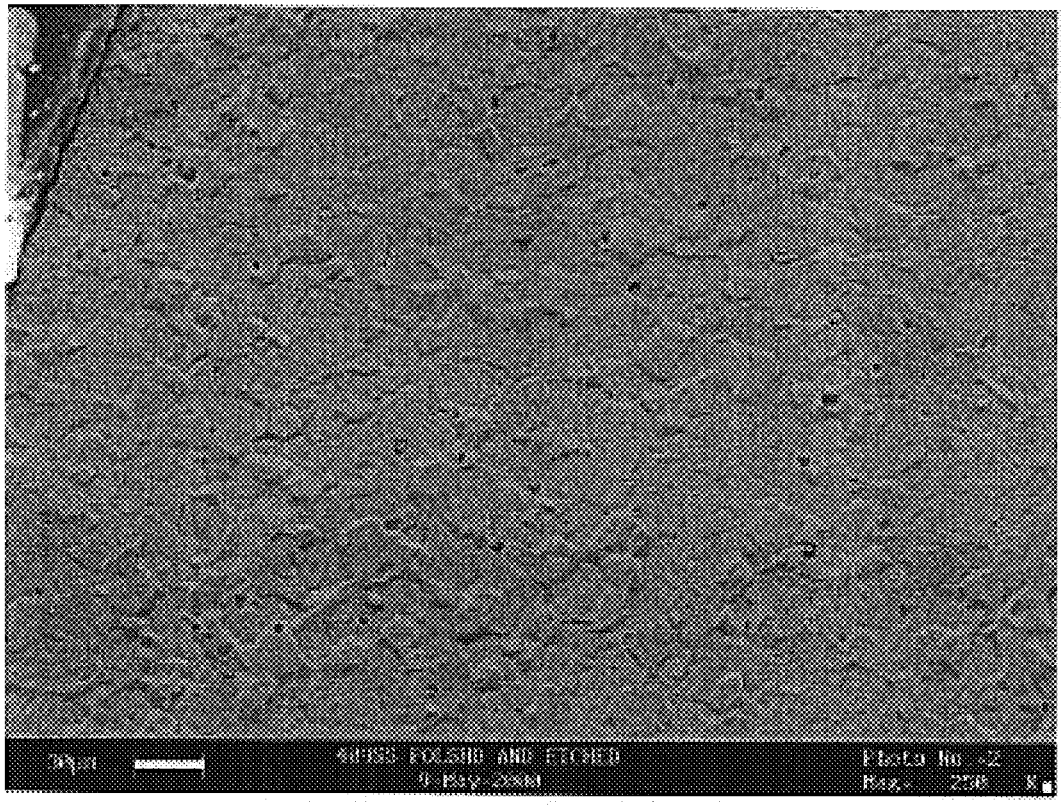
FIG. 5 is an SEM photograph of an as-received 409 stainless steel specimen cross section, see Comparative Example 2.
Figure 6:
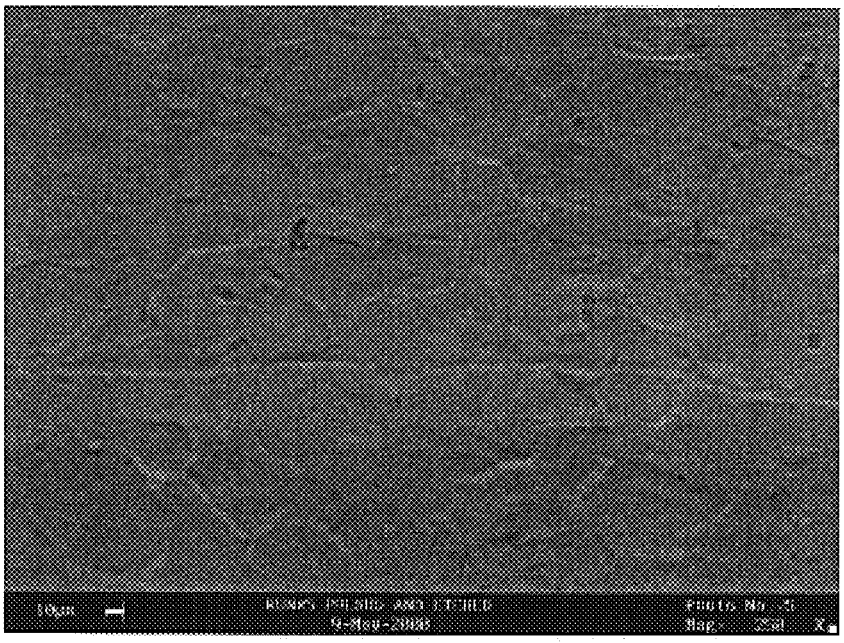
FIG. 6 is an SEM photograph of a Cr-coated 409 stainless steel specimen prepared in accordance with one embodiment of the invention, see Example 5.
Figure 7:
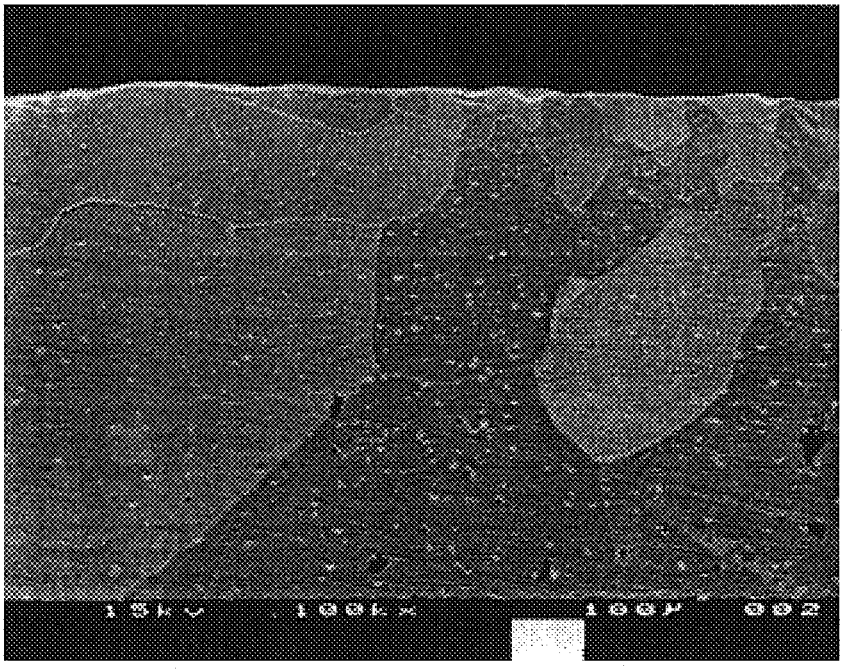
FIG. 7 is an SEM photograph of a Cr-coated 409 stainless steel specimen prepared by pack cementation, see Comparative Example 3.

FIGS. 5, 6 and 7 are SEM photographs of the surfaces of Comparative Example 2, Example 5 and Comparative Example 3, respectively. The average grain size of the as-received 409 stainless steel coupon of Comparative Example 2 was about 10–20 $\mu$m. The average grain size of the specimen in Example 5 was about 30–40 $\mu$m indicating some grain growth during the coating process. This minimal amount of grain growth is unlikely to detrimentally affect the physical properties of the substrate and thus, should be acceptable in most applications. Conversely, as shown by FIG. 7, the coating prepared by the pack cementation process in Comparative Example 3 showed significantly large grain growth (please note the difference in scale). In Comparative Example 3, the average grain size was about 200–500 $\mu$m. Those skilled in the art and guided by the teachings herein provided will appreciate that such enlarged grain sizes may present a serious concern in at least certain applications where the mechanical properties of the substrate are important in the finished product.

Examples 6–9 and Comparative Examples 4–7

In these tests, the corrosion resistance of Cr-coated 409 stainless steel coupons prepared in accordance with Example 1, described above, and as received 409 stainless steel coupons were evaluated using salt-containing acidic solutions such as may be present or occur in condensing heat exchanger applications, i.e., solutions containing sulfate and/or nitric anions. In particular, Examples 6 and 7 and Comparative Examples 4 and 5 employed a solution of 26 ppm NaCl+0.001N $H_2SO_4$ at temperatures of 20° C. and 60° C., respectively. Similarly, Examples 8 and 9 and Comparative Examples 6 and 7 employed a solution of 2600 ppm NaCl+0.001N $H_2SO_4$ at temperatures of 20° C. and 60° C., respectively. These test solutions represent typical and extreme conditions that heat exchanger tubes experience in the field.

The corrosion rates were measured using Tafel experiments and electrochemical impedance analysis, as is well known and accepted for measuring corrosion. In the Tafel experiments, the metal specimen was polarized anodically and cathodically 100 mV from the natural corrosion potential. The resulting current was plotted in a log I vs. E graph and fitted to the Stern-Geary equation using a non-linear least squares technique to obtain anodic and cathodic Tafel slopes ($b_a$ and $b_c$) and the corrosion rate. In the AC impedance analysis, a small sinusoidal waveform (5 mV) was applied on the electrode at the natural corrosion potential of the metal. The frequency of the sine wave was swept from about 10 kHz to 1 mHz and the resulting current information was collected along with its phase relationship to the original waveform and presented in Nyquist plots ($Z_{imaginary}$ VS. $Z_{real}$). Polarization resistance, which is inversely proportional to the corrosion current, was calculated from the X-axis intercepts of the semicircle fit. The proportionality constant is a function of anodic and cathodic Tafel slopes. Therefore, the corrosion rate can be calculated using polarization resistance from AC impedance analysis and Tafel slopes from a potential scan. In some cases, AC impedance itself is used as a quantitative measure of corrosion protection by comparing polarization resistance of coated and uncoated specimens.

Results

TABLE 1, below, summarizes the corrosion rates realized in these tests.

TABLE 1

| | CORROSION RATE (mpy) | | | |
|---|---|---|---|---|
| | 26 ppm NaCl + 0.001N $H_2SO_4$ | | 2600 ppm NaCl + 0.001N $H_2SO_4$ | |
| SPECIMEN | 20° C. | 60° C. | 20° C. | 60° C. |
| as received - Comparative Examples 4–7 | 16 | ~200 | 90 | >200 |
| coated - Examples 6–9 | 0.002 | 0.01 | 0.3 | 1.4 |

TABLE 1 clearly show the orders of magnitude improvement of the corrosion resistance achieved by application of the corrosion resistant diffusion coating to the substrate metal via a fluidized bed application in accordance with the invention. With regard to as-received 409 SS specimens, the corrosion rate at 60° C. was very high and accurate corrosion rate measurements were impeded as the metal was undergoing rapid dissolution with hydrogen evolution. The improved corrosion resistance realized through the practice of the invention is believed to be particularly significant when compared to corrosion resistance at ambient temperature described in above-identified prior art.

It is to be understood that the discussion of theory, such as the discussion of the relationship between avoiding a well-defined interface between the substrate and the coating and avoidance of delamination as well as the metal transport mechanism believed associated with fluidized bed application of the coating onto a substrate and the effect of temperature on grain growth, for example, are each included to assist in the understanding of the subject invention and are in no way limiting to the invention in its broader applications.

Thus, the invention provides improved structures in contact with a condensing heat exchanger environment as well as methods for improving the corrosion resistance of a structure comprising a metal substrate, the structure including a surface portion at least partially exposed to a condensing heat exchanger environment such as to more freely permit the use of lower cost metals in such applications without incurring the undesired risks or complications associated with corrosion of such lower costs metals. In particular, the invention provides structures and methods which permit the use of low-cost substrate metals, such as carbon steel and stainless steel, for example.

The invention illustratively disclosed herein suitably may be practiced in the absence of any element, part, step, component, or ingredient which is not specifically disclosed herein.

While in the foregoing detailed description this invention has been described in relation to certain preferred embodiments thereof, and many details have been set forth for purposes of illustration, it will be apparent to those skilled in the art that the invention is susceptible to additional embodiments and that certain of the details described herein can be varied considerably without departing from the basic principles of the invention.

What is claimed is:

1. An apparatus comprising:

an inlet header having a combustion products inlet in fluid communication with a combustion products source;

an outlet header having a liquid drain and forming a combustion products outlet;

at least one ferrous metal combustion products conduit having an interior wall surface and an exterior wall surface and having a conduit inlet in fluid communication with said inlet header and a conduit outlet in fluid communication with said outlet header, said interior wall surface coated with a corrosion resistant diffusion coating comprising at least one coating metal selected from the group consisting of Cr, Si and Ti; and combustion products disposed within said at least one ferrous metal combustion products conduit.

2. The apparatus of claim 1 wherein the ferrous substrate metal is carbon steel.

3. The apparatus of claim 1 wherein the ferrous substrate metal is a stainless steel.

4. The apparatus of claim 1 wherein the combustion products comprise at least one condensing salt.

5. The apparatus of claim 1 wherein the combustion products comprise at least one condensing salt selected from the group consisting of chlorides, sulfates, nitrates and mixtures thereof.

6. The apparatus of claim 1 wherein the combustion products comprise the condensing salt sodium chloride.

7. The apparatus of claim 1 wherein the combustion products comprise the condensing salt sodium sulfate.

8. The apparatus of claim 1 additionally comprising:

at least one compound selected from the group consisting of carbides, borides, nitrides, suicides, oxides and mixtures thereof passivated onto the diffusion coated substrate.

* * * * *